US006149398A

United States Patent [19]

Fukanuma et al.

[11] Patent Number: 6,149,398

[45] Date of Patent: Nov. 21, 2000

[54] VARIABLE CAPACITY PISTON- OPERATED REFRIGERANT COMPRESSOR WITH AN OIL SEPARATING MEANS

[75] Inventors: Tetsuhiko Fukanuma; Shintaro Miura; Takuya Okuno; Eiji Tokunaga, all of Kariya, Japan

[73] Assignee: Kabushiki Kaisha Toyoda Jidoshokki Seisakusho, Kariya, Japan

[21] Appl. No.: 09/264,499

[22] Filed: Mar. 8, 1999

[30] Foreign Application Priority Data

Mar. 16, 1998 [JP] Japan ..... 10-065731

[51] Int. Cl.[7] ..... F04B 1/26

[52] U.S. Cl. ..... 417/222.2; 184/6.17

[58] Field of Search ..... 417/222.2, 295; D15/9; 62/115

[56] References Cited

U.S. PATENT DOCUMENTS

| | | | |
|---|---|---|---|
| 5,009,286 | 4/1991 | Ikeda et al. | 184/6.17 |
| 5,088,897 | 2/1992 | Kawai et al. | 417/269 |
| 5,882,180 | 3/1999 | Kawaguchi et al. | 417/222.2 |
| 6,015,269 | 1/2000 | Ota et al. | 417/222.2 |

FOREIGN PATENT DOCUMENTS

| | | |
|---|---|---|
| 0 628 722 A1 | 12/1994 | European Pat. Off. . |
| 0 794 331 A2 | 9/1997 | European Pat. Off. . |
| 197 03 216 A1 | 8/1997 | Germany . |
| 3-37378 | 2/1991 | Japan . |
| 6-93967 | 4/1994 | Japan . |
| 7-332250 | 12/1995 | Japan . |
| 8-284819 | 10/1996 | Japan . |

*Primary Examiner*—Charles G. Freay

*Attorney, Agent, or Firm*—Woodcock Washburn Kurtz Mackiewicz & Norris LLP

[57] ABSTRACT

A variable capacity piston-operated refrigerant compressor having a cylinder block provided with cylinder bores in which single-headed pistons are reciprocated to compress a refrigerant gas, and a housing assembly arranged on opposite ends of the cylinder block to define a crank chamber for receiving a cam plate mounted around a rotatably supported drive shaft to cause the reciprocating motion of the pistons in response to the rotation thereof together with the drive shaft, the cam plate further controlling the stroke of the reciprocation of the pistons by the use of a differential pressure between a suction pressure acting on working ends of the respective pistons via a suction chamber and a pressure in the crank chamber communicating with a discharge chamber via a gas supply passage for supplying the discharge pressure refrigerant gas containing therein a lubricating oil which is separated from the refrigerant gas by the oil separating means arranged in the gas supply passage immediately before the refrigerant gas enters the crank chamber. The separated lubricating oil is stored in the crank chamber to lubricate all movable elements in the crank chamber.

10 Claims, 2 Drawing Sheets

VARIABLE CAPACITY PISTON- OPERATED REFRIGERANT COMPRESSOR WITH AN OIL SEPARATING MEANS

BACKGROUND OF THE INVENTION

1. Field of the Invention

The present invention relates to a refrigerant compressor for an air-conditioning system and, more particularly, relates to a single-headed piston type variable capacity refrigerant compressor including a non-clutch type variable capacity refrigerant compressor.

2. Description of the Related Art

A conventional variable capacity refrigerant compressor such as a variable inclination swash plate type refrigerant compressor or a wobble plate type refrigerant compressor is used for compressing a refrigerant gas to be supplied to an air-conditioning system or a climate control system. In the conventional variable capacity refrigerant compressor, a variable inclination swash plate or wobble plate acting as a cam plate to convert a rotating motion of a drive shaft into a reciprocating motion of single-headed pistons within axial cylinder bores is incorporated in a crank chamber, and the cam plate is mounted around the drive shaft in such a manner that its angle of inclination about a fulcrum can be changed with respect to a plane perpendicular to the axis of rotation of the drive shaft. The angle of inclination of the cam plate is adjustably changed by controlling a pressure differential between a first pressure prevailing in the crank chamber and acting on the back end of each of the respective single-headed pistons and a second pressure, i.e., a pressure of the refrigerant gas (a suction pressure) acting on the front end of each of the respective pistons. When the angle of inclination of the cam plate about the fulcrum is adjustably changed, the respective pistons change their reciprocating stroke within the cylinder bores, and accordingly, the amount of the refrigerant gas compressed within the cylinder bores and discharged from the cylinder bores into the discharge chamber of the compressor is varied per one complete rotation of the drive shaft. The controlling of the above-mentioned pressure differential is usually conducted, in response to a change in a refrigerating load applied by the air-conditioning system onto the compressor, by adjustably controlling the first pressure prevailing in the crank chamber via a supply of an adjusted partial amount of the compressed refrigerant gas from the discharge chamber into the crank chamber. The amount of the supply of the compressed refrigerant gas is controlled by a control valve.

Alternatively, the controlling of the above-mentioned pressure differential can be conducted by constantly regulating the first pressure prevailing in the crank chamber, to a predetermined unchanging pressure level, so that a change in the suction pressure due to a change in the refrigerating load directly causes a change in the pressure differential. The regulation of the first pressure is conducted by supplying a partial adjusted amount of the compressed refrigerant gas from the discharge chamber into the crank chamber through a choke provided in a gas passageway extending from the discharge chamber to the crank chamber and by controlling an amount of withdrawal of the gas from the crank chamber toward an appropriate suction pressure region in the compressor via a control valve.

Japanese Unexamined Utility Model Application (Kokai) No. 3-37378 (hereinafter referred to as JP-A-3-37378) discloses a refrigerant compressor for a vehicle climate control system which does not employ a solenoid clutch between an external drive source and a drive shaft of the compressor for connecting and disconnecting a transmission of a drive power from the drive source to the drive shaft. Elimination of the solenoid clutch from the refrigerant compressor for a vehicle climate control system is advantageous from the viewpoint of improving the driving performance of the vehicle engine and of reducing the manufacturing cost and the net weight of the refrigerant compressor.

Nevertheless, a refrigerant compressor with no solenoid clutch as disclosed in JP-A-3-37378 must suffer from a problem such that since the compressor continues to discharge a small amount of the compressed refrigerant gas even when the refrigeration of the vehicle by the climate control system is not necessary, frost is deposited on an outer surface of an evaporator of the vehicle climate control system. Therefore, in the refrigerant compressor of JP-A-3-37378, a particular solenoid-operated valve is arranged in the refrigerant gas conduit running through the climate control system and the refrigerant compressor in order to prevent a return of the refrigerant gas from the system to the suction chamber of the refrigerant compressor. Namely, by preventing the return of the refrigerant gas from the system to the compressor, the discharge of the refrigerant gas from the compressor to the climate control system can be suppressed.

However, in the variable capacity refrigerant compressor with or without a solenoid clutch, while the refrigerant compressor operates under an intermediate capacity condition due to the capacity control made in response to a change in a refrigerating load from the vehicle refrigerating system, the crank chamber receiving a variable inclination type cam plate therein is supplied with a given amount of the compressed refrigerant gas from the discharge chamber via a gas supply passage, and various movable elements such as the cam plate and shoes are lubricated by oil particles suspended in the supplied refrigerant gas. The gas supply passage arranged to extend through a portion of the cylinder block is formed as a straight path extending linearly and having a bore diameter determined so as contribute only to the control of the discharge capacity of the compressor. Thus, as soon as the refrigerant gas suspending therein the lubricating oil particles enters the crank chamber having a large volume, after passing through the gas supply passage, the suspended oil particles are separated from the refrigerant gas due to loss of the flow speed of the refrigerant gas within the crank chamber. Since the interior of the crank chamber is usually maintained at a rather high temperature because of an existence of various moving elements which frictionally generate heat during the operation thereof, the lubricating oil becomes an oil mist within the crank chamber while the oil is agitated by the cam plate rotating or wobbling within the crank chamber. Thus, the oil mist is easily carried by the refrigerant gas toward the suction chamber through a gas withdrawal passage to result in a shortage of the lubricating oil within the interior (a bottom portion) of the crank chamber. Therefore, lack of lubrication for all the movable elements in the compressor occurs.

On the other hand, in the described variable capacity refrigerant compressor without a solenoid clutch, when the solenoid valve is closed to stop the refrigerating operation of the climate control system during the continuous operation of the compressor, the suction pressure within the suction chamber of the compressor responsively falls while causing an operation of the capacity control valve to move the refrigerant compressor to its minimum capacity operation. Accordingly, only a small amount of the refrigerant gas is circulated through the cylinder bores, the discharge chamber, the gas supply passage, the crank chamber, the gas withdrawal passage, and the suction chamber within the compressor. However, the above circulating flow of the refrigerating gas is different from an ordinary circulating flow of the refrigerant gas through the climate control system, and accordingly, the refrigerant gas becomes a high temperature gas which allows the movable elements including the cam plate, the shoes, and the shaft sealing device to be heated by friction during the movements of these movable elements. Consequently, each of the movable elements lacks lubrication, and therefore, the mechanical durability of the movable elements of the refrigerant compressor is reduced to reduce the life of operation of the refrigerant compressor per se.

SUMMARY OF THE INVENTION

Therefore, an object of the present invention is to solve the above-described problems encountered by a variable capacity refrigerant compressor having no solenoid clutch between an external drive power source and a drive shaft of the compressor when the refrigerant compressor is incorporated in a refrigerating system having a solenoid valve in a refrigerant gas conduit through which the flow of the refrigerant gas is circulated through the refrigerating system and the refrigerant compressor.

Another object of the present invention is to provide a variable capacity refrigerant compressor having no solenoid clutch between an external drive power source and a drive shaft of the compressor and provided with a novel means for providing various movable elements of the compressor with a sufficient amount of lubricating oil even when the refrigerant compressor is operated either at an intermediate capacity condition thereof or at a condition where no refrigeration is required, in order to extend the operating life of the variable capacity refrigerant compressor.

In accordance with the present invention, there is provided a variable capacity piston-operated refrigerant compressor which comprises:

a cylinder block provided with a plurality of cylinder bores formed therein;

a housing means connected to the cylinder block and defining a crank chamber, a suction chamber for a refrigerant gas before compression, and a discharge chamber for the refrigerant gas after compression, the refrigerant gas containing and suspending therein a lubricating oil;

a drive shaft supported rotatably about an axis of rotation thereof within the crank chamber;

pistons movably received in the cylinder bores of the cylinder block and reciprocating to compress the refrigerant gas introduced from the suction chamber and to discharge the compressed refrigerant gas from the cylinder bores into the discharge chamber;

a cam plate element mounted around the drive shaft to be rotated with the drive shaft and able to change an angle of inclination thereof with respect to a plane perpendicular to the axis of rotation of the drive shaft to thereby cause a change in the stroke of the reciprocating motion of the pistons;

a gas supply passage extending between the discharge chamber and the crank chamber;

a gas withdrawal passage extending between the crank chamber and the suction chamber;

a capacity control valve means arranged in the housing means to control the angle of inclination of the cam plate; and, an oil separating means for separating the lubricating oil suspended in the refrigerant gas from the refrigerant gas, the separating means being arranged in the gas supply passage.

When the gas withdrawal passage of the above-described variable capacity piston-operated refrigerant compressor is provided with a choke portion formed therein, the capacity control valve is preferably arranged so as to supply the refrigerant gas after compression from the discharge chamber into the crank chamber to thereby adjustably change the pressure prevailing in the crank chamber in order that the stroke of the reciprocating motion of the pistons is adjusted in response to a change in the refrigerating load.

In the above-described variable capacity piston-operated refrigerant compressor, when the refrigerant gas containing the lubricating oil therein flows from the discharge chamber into the crank chamber through the gas supply passage, the oil separating means surely causes physical separation of the lubricating oil from the refrigerant gas due to a difference between the specific gravity of the lubricating oil and that of the refrigerant gas, before the refrigerant gas enters the crank chamber, and allows the separated lubricating oil to flow down into the bottom portion of the crank chamber so as to be reserved there. Thus, the crank chamber can constantly reserve an appreciable amount of the lubricating oil to lubricate various movable elements of the compressor. Namely, lack of lubrication of the movable elements can be prevented even when the variable capacity refrigerant compressor operates in its intermediate capacity condition.

Further, when the above-described variable capacity piston-operated refrigerant compressor is not provided with a solenoid clutch between the drive shaft and an external drive source, and is incorporated in a refrigerating system via a solenoid valve between the gas inlet port of the compressor and the evaporator of the refrigerating system, the oil separating means is able to separate the lubricating oil from the refrigerant gas immediately before the refrigerant gas enters the crank chamber, even when the solenoid valve is closed to stop the refrigerating operation of the refrigerating system and when the flow of the refrigerant gas is circulated only through the suction chamber, the discharge chamber and the crank chamber of the compressor.

Preferably, the oil separating means comprises a cavity portion enclosed by a wall to have a substantial transverse cross sectional area and formed at an end region of the gas supply passage to be arranged adjacent to the crank chamber. The cavity portion having the substantial cross sectional area permits the flow of the refrigerant gas coming from the gas supply passage to be suddenly decelerated immediately before the refrigerant gas enters the crank chamber and accordingly, the lubricating oil suspended in the refrigerant gas having a specific gravity larger than that of the refrigerant gas is separated from the refrigerant gas due to the force of gravity.

The wall of the cavity portion preferably comprises a cylindrical wall forming the cavity portion as a cylindrical cavity portion. Then, further preferably, the cylindrical cavity portion is arranged to be eccentric and downwardly deviated from the end of the gas supply passage. Thus, the separated lubricating oil tends to drop to a lowermost region of the cavity portion, and accordingly, separation of the lubricating oil from the refrigerant gas is encouraged while preventing the lubricating oil from being again included in the flow of the refrigerant gas.

Preferably, a meshed member or a screen member is arranged in the cavity portion to promote the separation of the lubricating oil from the refrigerant gas due to collision of the flow of the refrigerant gas against the mesh member immediately before the refrigerant gas coming from the discharge chamber enters the crank chamber via the cavity portion.

BRIEF DESCRIPTION OF THE DRAWINGS

The above and other objects, features and advantages of the present invention will be made more apparent from the ensuing description of preferred embodiments thereof with reference to the accompanying drawings wherein.

DESCRIPTION OF THE PREFERRED EMBODIMENTS

Figure 1:
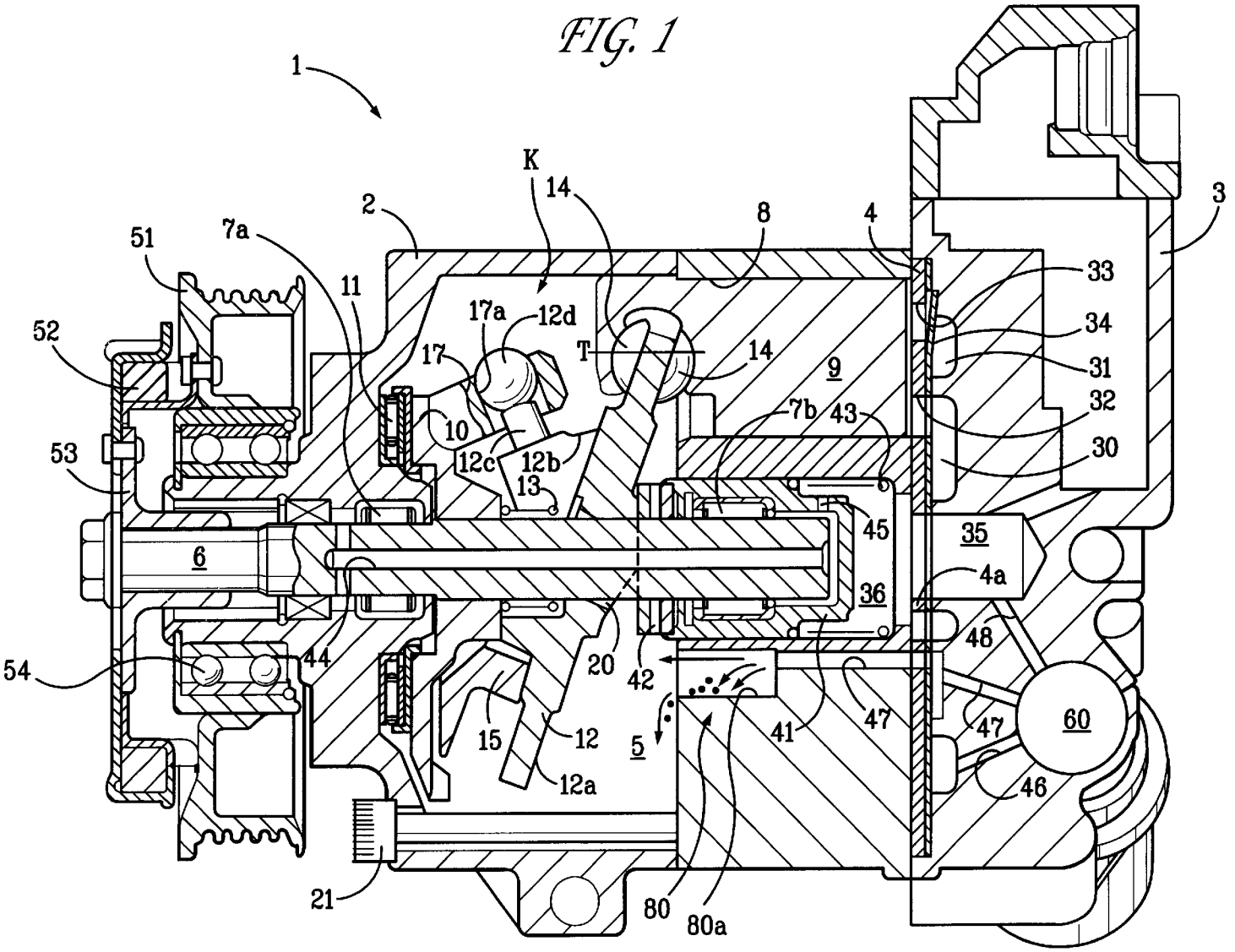
FIG. 1 is a longitudinal cross-sectional view of a variable capacity single-headed-piston-operated refrigerant compressor according to an embodiment of the present invention.

Referring to FIG. 1, a variable capacity single-headed-piston-operated refrigerant compressor is constructed to have no solenoid clutch between a drive shaft thereof and an external drive power source (not shown) such as a vehicle engine. The refrigerant compressor is provided with a cylinder block 1 having a plurality of axial cylinder bores 8 arranged around a central axis of the cylinder block 1. The cylinder block 1 has a front end to which a bell jar-like front housing 2 is sealingly attached, and a rear end to which a rear housing 3 is attached via a valve plate 4. The front housing 2, the cylinder block 1, and the rear housing 3 are tightly combined together by a plurality of through screw bolts 21. The front housing 2 defines a crank chamber 5 located in front of the front end of the cylinder block 1, and a drive shaft 6 is rotatably supported by the cylinder block 1 and the front housing 2 via front and rear radial bearings 7*a* and 7*b*. The drive shaft 6 extends through the crank chamber 5 and has a frontmost end portion extending beyond a front flange portion of the front housing 2. A drive pulley element 51 is mounted on the frontmost portion of the drive shaft 6 via a shock absorbing member 52 and a hub element 53. The drive pulley element 51 has an outer belt engaging circumference around which a belt member (not shown) is engaged to provide a connection between the drive shaft 6 and an external drive power source such as a vehicle engine. The drive pulley element 51 is rotatably mounted around the flange portion of the front housing 2 via a bearing device 54, and the rotation of the drive pulley element 51 is transmitted to the drive shaft 6 via the hub element 53 fixed to the frontmost end portion of the drive shaft 6.

The refrigerant compressor is further provided with a plurality of single-headed pistons 9 axially slidably received in the cylinder bores 8 of the cylinder block 1.

Within the crank chamber 5, a rotor element 10 is fixedly mounted on the drive shaft 6 and axially supported by an inner wall of the front housing 2 via a thrust bearing 11. Thus, the rotor element 10 is rotatable with the drive shaft 6. A cam plate or swash plate 12 is mounted around the drive shaft 6 behind the rotor element 10 and is constantly urged rearwardly by a spring 13. The swash plate 12 is provided with an annular marginal portion formed to have opposite flat faces 12*a* which are held between flat faces of two semispherical shoes 14, 14. A spherical portion of each of the two shoes 14, 14 is slidably received in spherical recesses formed in a back end portion of each of the pistons 9. Thus, the swash plate 13 is engaged with the plurality of single-headed pistons 9 via two shoes 14, 14 received by each of the pistons 9.

The swash plate 12 is further provided with a pair of brackets 12*b*, 12*b* formed at a portion of one of the opposite sides thereof and arranged radially inside the annular marginal portion 12*a*. The two brackets 12*b*, 12*b* are further arranged so that each of the brackets 12*b*, 12*b* is located on one of the two sides with respect to a top dead center position "T" of the swash plate 12. The two brackets 12*b*, 12*b* are connected to base ends of two guide pins 12*c*, 12*c* which have spherical ends 12*d*, 12*d* at ends opposite to the above-mentioned base ends. The two spherical ends 12*d*, 12*d* of the respective guide pins 12*c*, 12*c* are engaged in a later-described guide bores 17*a*, 17*a* which are bored in each of two inclined support arms 17, 17 extending from a portion of the rotor element 10 into the crank chamber 5.

The above-described two brackets 12*b*, 12*b*, the two guide pins 12*c*, 12*c*, and the two spherical ends 12*d*, 12*d* form a moving part of a hinge mechanism "K" permitting the swash plate 12 to perform a controlled movement by which an angle of inclination of the swash plate 12 is changed with respect to a plane perpendicular to the axis of rotation of the drive shaft 6.

The swash plate 12 is centrally provided with a curved through bore 20 which permits the swash plate 12 to turn about an axis perpendicular to the axis of rotation of the drive shaft 6 in order to change the angle of inclination thereof. The swash plate 12 is further provided with a counterweight 15 attached to the face thereof confronting the rotor element 10. The counterweight 15 is formed as a solid member extending, radially outwardly with respect to the axis of rotation of the drive shaft 6, and is attached to a region of the face of the swash plate 12 which includes a bottom dead center of the swash plate 12. The counterweight 15 is arranged to be spaced from the annular marginal face 12*a* in order to avoid an interference with any of the paired shoes 14, 14 held by each piston 9 during the rotation of the swash plate 12 around the drive shaft 6. As can be seen from FIG. 1, a maximum angle of inclination of the swash plate 12 is determined by a projecting portion thereof which comes into contact with a radially inner portion of the rotor element 10 when the angle of inclination of the swash plate 12 increases. Thus, the projecting portion of the swash plate 12 is formed at a position radially inside the portion to which the above-mentioned counterweight 15 is attached.

The two support arms 17 with the two guide bores 17*a* form a supporting part of the afore-mentioned hinge mechanism "K", and therefore, the guide bores 17*a*, 17*a* receive the two spherical ends 12*d*, 12*d* of the guide pins 12*c* to be slidable therein. The guide bores 17*a*, 17*a* are formed as radial through bores inclining from a plane vertical to the axis of rotation of the drive shaft 6, and an inclining angle of the two guide bores 17*a*, 17*a* are determined so that the top dead center of each piston 9 is constantly unchanged irrespective of a change in the inclination angle of the swash plate 12 on the drive shaft 6 via the sliding motion of the spherical ends 12*d* of the guide pins 12*c*.

The rear housing 3 is provided with a suction chamber 30 for a refrigerant gas before compression and a discharge chamber 31 for the refrigerant gas after compression. The valve plate 4 is provided with suction ports 32 formed therein at positions opening toward the respective cylinder bores 8 and discharge ports 33 formed therein at other positions opening toward the respective cylinder bores 8. The cylinder bores 8 define therein compression chambers between the working ends of the respective pistons 9 and the valve plate 4 to compress the refrigerant gas. The compression chambers of the respective cylinder bores 8 are able to communicate with the suction chamber 30 via the suction ports 32, and with the discharge chamber 31 via the discharge ports 33. Each of the suction ports 32 is closed by a suction valve which can move to a port-opening position when the piston 9 carries out its sucking movement within the cylinder bore 8. Further, each of the discharge ports 33 is closed by a discharge valve which can move to a port-open position determined by a retainer element 34 when the piston 9 carries out its discharging movement within the cylinder bore 8.

The rear housing 3 is further provided with a cavity portion forming a part of a gas suction passage 35 which further includes a central bore 4*a* formed in the valve plate 4 and a central bore 36 formed in the cylinder block 1. The central bore 36 of the cylinder block 1 receives therein a later-described suction choking mechanism which operates in association with a change in the angle of inclination of the swash plate 12.

The suction choking mechanism includes a cylindrical spool valve element 41 as a main element thereof which receives an end of the drive shaft 6 via the radial bearing 7*b*, and is sliadably fitted in the central bore 36 of the cylinder block 1. The cylindrical spool valve element 41 is provided with a front end thereof which is in contact with a portion of the swash plate 12 via a thrust bearing 42 and a rear end engaging with one end of a return spring 43 having the other end seated at an innermost annular wall of the central bore 36 of the cylinder block 1. Thus, the return spring 43 constantly urges the spool valve element 41 frontwardly toward the swash plate 12 until the front end of the spool valve element 41 is moved to a frontmost position exposed to the crank chamber 5.

The cylindrical spool valve element 41 can be moved in the central bore 36 to a position where the rear end of the spool valve element 41 closes the gas suction passage 35 at the end of the central bore 4*a* of the valve plate 4 in response to a change in the angle of inclination of the swash plate 12 to the minimum angle.

The drive shaft 6 is provided with a central bore 44 extending axially from the rear end of the drive shaft 6 and functioning as a gas withdrawal passage. The central bore 44 of the drive shaft 6 has a front open end opening into a position adjacent to the front radial bearing 7*a*, and a rear open end opening so as to communicate, with the central bore 36 of the cylinder block 1 and the suction chamber 30, via a small orifice 45 which is formed in a cylindrical wall of the spool valve element 41 at a position adjacent to a closed end of the spool valve element 41. The small orifice 45 is provided as a choke portion arranged in the gas withdrawal passage.

The central bore 36 of the cylinder block 1 further communicates with the crank chamber 5 through a passage which extends through the small orifice 45, the radial bearing 7*b*, and the thrust bearing 42 to withdraw the gas from the crank chamber 5 into a suction pressure region including the suction chamber 30.

It should be noted that even when the central bore 4*a* of the valve plate 4 is closed by the rear end of the spool valve element 41, the central bore 36 of the cylinder block 1 communicates with the suction chamber 30 via a small gap between the rear end of the spool valve element 41 and the innermost annular wall of the central bore 36 of the cylinder block 1 to form a part of a gas circulating passage passing through the crank chamber 5.

Figure 2:
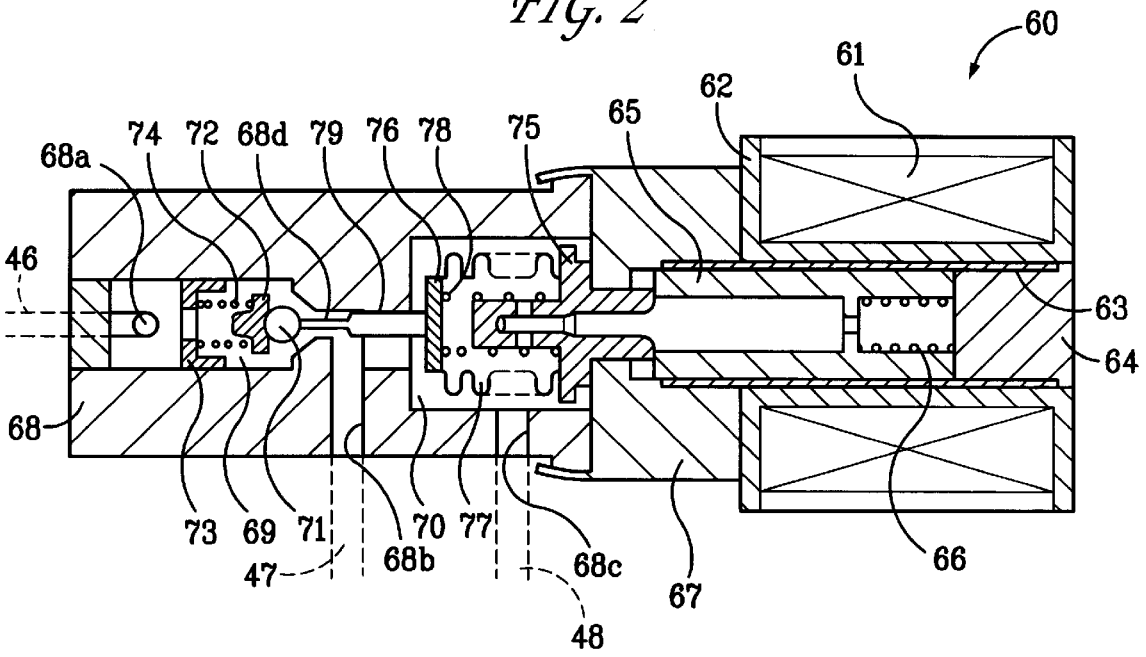
FIG. 2 is a cross-sectional view of a capacity control valve incorporated in the refrigerant compressor of FIG. 1; and, FIG. 3 is a partial perspective view of an oil separating means according to a different embodiment of the present invention.

FIG. 2 illustrates the internal construction of the capacity control valve 60 housed in the rear housing 3.

The capacity control valve 60 is provided with a solenoid 61 supported by a bobbin 62 having a central bore in which a guide cylinder 63 is fixedly inserted. The guide cylinder 63 has one end in which a stationary iron core 64 is fixedly seated. A movable iron core 65 is inserted in the guide cylinder 63 so that an end of the movable iron core 65 is moved to a position in contact with the stationary iron core 64 and away from this contacting position. A spring element 66 arranged between the stationary iron core 64 and the movable iron core 65 constantly urges the movable iron core 65 in a direction away from the stationary iron core 64. The bobbin 62 of the capacity control valve 60 is connected to a main body 68 by a connecting member 67, and the main body 68 defines a discharge pressure chamber 69 and a suction pressure chamber 70 formed therein.

The main body 68 is further provided with a pressure introducing port 68*a* communicating with the discharge pressure chamber 69, and a gas supplying port 68*b* communicating with the discharge pressure chamber 69 via a valve port 68*d*, and a pressure detecting port 68*c* communicating with the suction pressure chamber 70. The pressure introducing port 68*a* is fluidly connected to the discharge chamber 31 of the rear housing 3 via a pressure introducing passage 46 formed in the rear housing 3. The gas supplying 68*b* is fluidly connected to the crank chamber 5 via a gas supply passage 47 formed in the rear housing 3. The pressure detecting port 68*c* is fluidly connected to the suction passage 35 and the suction chamber 30 via a pressure detecting passage 48. The valve port 68*d* arranged adjacent to an end of the discharge pressure chamber 69 is closed and opened by a valve element 71 which is constantly urged toward a port closing position by a spring 74 arranged between a valve supporting seat 72 and a spring seat 73.

The suction pressure chamber 70 receives therein a bellows element 77 having one end closed by a supporting member 75 fixed to the movable iron core 65 and the other end closed by a seat plate 76. The bellows element 77 receives therein a spring 78 having one end seated on the end of the supporting member 75 and the other end engaged with the seat plate 76. Therefore, the bellows element 77 is extended and contracted by a differential force between a force exhibited by the spring 78 and a force due to a suction pressure prevailing in the suction pressure chamber 70 and acting on the surface of the bellows element 77. The extension and contraction of the bellows element 77 causes a movement of the seat plate 76 to which a control rod 79 having one end being in contact with the valve element 71 is attached.

When the solenoid 6 is electrically energized in response to an on signal supplied from an air-condition operating switch (not shown), the movable iron core 65 is attracted toward the stationary iron core 64 against the spring force of the spring 66 and, therefore, the capacity control valve 60 operates in response to a change in the suction pressure of the compressor to control a pressure prevailing in the crank chamber 5. This operation of the capacity control valve 60 occurs irrespective of the provision of a solenoid clutch between the external drive power source and the drive shaft 6 of the refrigerant compressor.

When the air-condition operating switch is shifted to supply an off signal to the capacity control valve 60 to de-energize the solenoid 61, the movable iron core 65 is moved away from the stationary iron core 64, and as a result, the valve element 71 is urged to move to its position where the valve port 68*d* is maintained at the maximum open position thereof. Namely, the operation of the refrigerant compressor is shifted to a specified no-refrigerant-supply operation which is peculiar to the refrigerant compressor with no solenoid clutch, and does not require the compressor to supply the compressed refrigerant gas to the refrigerating system.

In accordance with the feature of the present invention, the gas supply passage 47 in the rear cylinder block 3 is provided with an oil separating means 80 for separating lubricating oil component contained and suspended in the refrigerant gas from the refrigerant gas before the refrigerant gas enters the crank chamber 5. The oil separating means 80 according to a preferred embodiment of the present invention includes a cavity portion 80*a* which is formed by cylindrically enlarging an end portion of the gas supply passage 47 opening into the crank chamber 5. Namely, the cavity portion 80*a* has a transverse cross sectional area far larger than that of the gas supply passage 47. Further, an axial length of the cavity portion 80*a* is determined so that a physical separation of the lubricating oil from the refrigerant gas is surely encouraged when the refrigerant gas suspending the lubricating oil therein passes through the cavity portion 80*a*.

It will be understood from FIG. 1 that the position of the cavity portion 80*a* of the oil separating means 80 is determined so that the central axis thereof is generally downwardly shifted from the central axis of the gas supply passage 47 when the drive shaft 6 is maintained at a horizontal condition.

During the operation of the refrigerant compressor, when the suction pressure is reduced in response to a reduction in a refrigerating load, the bellows element 77 of the capacity control valve 60 is axially extended to press the valve element 71 toward the opening position thereof apart from the valve port 68*d* as shown in FIG. 2. Thus, the refrigerant gas having a discharge pressure within the discharge pressure chamber 69 is supplied into the crank chamber 5 via the valve port 68*d*, the gas supplying port 68*b*, and the gas supply passage 47. Therefore, the pressure prevailing in the crank chamber 5 is increased to generate a pressure differential with respect to the suction pressure, and accordingly, the angle of inclination of the swash plate 12 and the stroke of the reciprocating motion of each piston 9 are reduced so as to shift the operation of the refrigerant compressor to an intermediate capacity operation thereof. When the capacity of the refrigerant compressor is reduced, a blow-by gas within the refrigerant compressor is in Lurn reduced. Thus, the lubrication of the movable elements in the crank chamber 5 of the refrigerant compressor such as the swash plate 12, the shoes 14, the hinge mechanism "K", the diverse bearings 7*a*, 7*b*, 11, 42, and the like must be achieved by the lubricating oil contained and suspended in the refrigerant gas.

At this stage, if the gas supply passage 47 is not provided with the oil separating means 80, when the refrigerant gas is introduced into the crank chamber 5 from the gas supply passage 47, a part of the refrigerant gas surely flows into the gas withdrawal passage 44 in the drive shaft 6 and into the passage extending through the thrust bearing 42 and the radial bearing 7*b*. Thus, the refrigerant gas returns to the suction pressure region including the suction chamber 30 while carrying the lubricating oil contained therein. As a result, only a part of the lubricating oil contained in the refrigerant gas contributes to the lubrication of the movable elements, and it cannot be stored in the crank chamber 5 as the lubricating oil stock. Thus, lack of lubrication of the movable elements of the refrigerant compressor occurs.

In the preferred embodiment of the present invention, the cavity portion 80*a* of the oil separating means 80 formed at the end of the gas supply passage 47 can surely cause separation of the lubricating oil from the refrigerant gas when the flow of the refrigerant gas containing therein the lubricating oil enters the cylindrically enlarged cavity portion 80*a* of the oil separating means 80. Namely, the separation of the lubricating oil from the refrigerant gas occurs because the flow of the refrigerant gas suspending therein the lubricating oil is suddenly decelerated as soon as the refrigerant gas enters the cavity portion 80*a* having a large cross sectional area and a large volume and the lubricating oil suspended in the refrigerant gas and having a specific gravity larger than that of the refrigerant gas is separated from the refrigerant gas due to an effect of the force of the gravity and drops on a bottom of the cavity portion 80*a* as shown in FIG. 1. The refrigerant gas from which the lubricating oil is separated continues to flow into the crank chamber 5. The lubricating oil on the bottom of the cavity portion 80*a* flows down into the bottom of the crank chamber 5 to be stored there. Further, since the cavity portion 80*a* is arranged to be downwardly shifted from the center of the gas supply passage 47, the lubricating oil separated from the refrigerant gas within the cavity portion 80*a* remaining in a region spaced apart from the flow of the refrigerant gas entering the crank chamber 5 from the cavity portion 80*a*, and accordingly, the lubricating oil is not carried once again by the flow of the refrigerant gas. Therefore, the lubricating oil stock in the crank chamber 5 increases to prevent a lack of lubrication of the movable elements in the crank chamber 5.

In the case of the refrigerant compressor with no solenoid clutch, when the air-conditioning switch is shifted to an off position to de-energize the solenoid 61 of the capacity control valve 60, the valve element 71 is moved to its position fully opening the valve port 68*d* in response to the movement of the movable iron core 65 away from the stationary iron core 64. Thus, the refrigerant gas at a high discharge pressure quickly flows from the discharge chamber 31 into the crank chamber 5 via the discharge pressure chamber 69 of the capacity control valve 60 to immediately increase the pressure in the crank chamber 5. Accordingly, the angle of inclination of the swash plate 12 is quickly changed to its minimum angle so as to quickly move the spool valve element 41 to its closing position closing the central bore 4*a* of the valve plate 4 against the spring force of the return spring 43. Thus, the flow of the refrigerant gas through the suction passage 35 is stopped. Therefore, the flowing-in of the refrigerant gas from the refrigerating system into the refrigerant compressor is basically stopped, and a small amount of the refrigerant gas compressed by the respective pistons 9 within the respective cylinder bores 8 is discharged from the cylinder bores 8 into the discharge chamber 31. The compressed refrigerant gas in turn flows from the discharge chamber 31 into the crank chamber 5 via the gas supply passage 47, and further flows from the crank chamber 5 toward the suction chamber 30 via the central bore 44, which functions as a gas withdrawal passage having the small orifice therein. Thus, the circulation of the refrigerant gas occurs within the refrigerant compressor through the cylinder bores 8, the discharge chamber 31, the gas supply passage 47, the crank chamber 5 and the suction chamber 30 and, during the circulation of the refrigerant gas, the oil separating means 80 having the enlarged cavity portion 80*a* arranged at the end of the gas supply passage 47 continues to separate the lubricating oil from the refrigerant gas to supply the separated lubricating oil into the bottom of the crank chamber 5. Therefore, the lubrication of the movable elements within the crank chamber 5 is continuously carried out due to the rotation of the swash plate 12 within the crank chamber 5 so long as the operation of the refrigerant compressor lasts.

Figure 3:
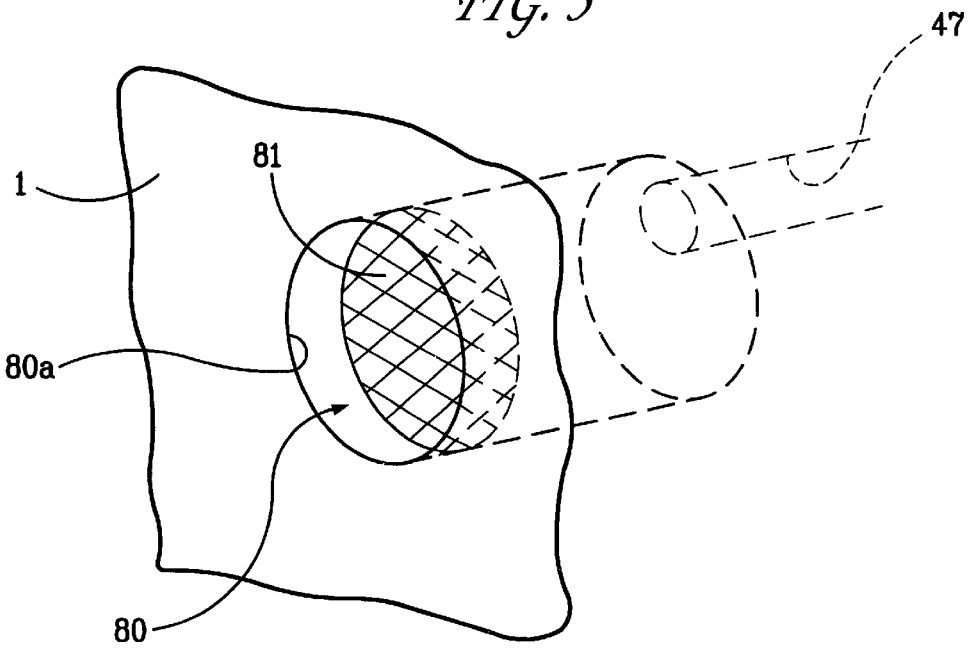

FIG. 3 illustrates an improved embodiment of the oil separating means 80, in which a meshed member or a screen member 81 is arranged. When the flow of the refrigerant gas containing therein the lubricating oil and supplied via the gas supply passage 47 collides with the screen member 81 before it enters the crank chamber 5, the separation of the lubricating oil from the refrigerant gas within the cavity portion 80*a* of the oil separating means 80 is further encouraged by the inertia effect and by a sudden change in the flowing direction provided by the collision of the lubricating oil against the screen member 81.

Although the foregoing description of the preferred embodiments is provided in connection with the variable capacity piston-operated refrigerant compressor with no solenoid clutch, the oil separating means of the present invention can be advantageously incorporated in different variable capacity piston-operated refrigerant compressors in which a change in the discharge capacity is performed by the use of a differential pressure between a crank chamber pressure and the suction pressure of the compressor.

It should be understood that many and various changes and modifications will occur to a person skilled in the art without departing from the scope and spirit of the present invention as claimed in the accompanying claims.

What we claim is:

1. A variable capacity piston-operated refrigerant compressor comprising:

a cylinder block provided with a plurality of cylinder bores formed therein;

a housing connected to said cylinder block and defining a crank chamber, a suction chamber for a refrigerant gas before compression, and a discharge chamber for said refrigerant gas after compression, the refrigerant gas containing a lubricating oil and suspending therein;

a drive shaft supported rotatably about an axis of rotation thereof within said crank chamber;

pistons movably received in said cylinder bores of said cylinder block and reciprocating to compress the refrigerant gas introduced from said suction chamber and to discharge the compressed refrigerant gas from said cylinder bores into said discharge chamber;

a cam plate element mounted around said drive shaft to be rotated with said drive shaft and able to change an angle of inclination thereof with respect to a plane perpendicular to the axis of rotation of said drive shaft to thereby cause a change in the stroke of the reciprocating motion of said pistons;

a gas supply passage extending between said discharge chamber and said crank chamber;

a gas withdrawal passage extending between said crank chamber and said suction chamber;

a capacity control valve arranged in said housing to control said angle of inclination of said cam plate; and an oil separating means for separating said lubricating oil suspended in said refrigerant gas, said separating means being arranged in said gas supply passage between said crank chamber and said capacity control valve.

2. A variable capacity piston-operated refrigerant compressor according to claim 1, wherein the capacity control valve adjustably changes a pressure differential between a pressure prevailing in said crank chamber so as to act on an end of each of said pistons and a suction pressure, acting on the opposite end of each of said pistons.

3. A variable capacity piston-operated refrigerant compressor according to claim 1, wherein said gas withdrawal passage is provided with a choke portion formed therein to restrict withdrawal of the refrigerant gas from said crank chamber to said suction chamber, and wherein said capacity control valve is provided for supplying said refrigerant gas after compression from said discharge chamber into said crank chamber to adjustably change the pressure prevailing in said crank chamber to thereby adjust the stroke of said reciprocating motion of said pistons in response to a change in the refrigerating load.

4. A variable capacity piston-operated refrigerant compressor according to claim 1, wherein said oil separating means comprises a cavity portion enclosed by a wall to have a substantial transverse cross-sectional area and formed at an end region of said gas supply passage to be arranged adjacent to said crank chamber, said cavity portion having a substantial cross sectional area permitting the flow of said refrigerant gas coming from said gas supply passage to be suddenly decelerated immediately before said refrigerant gas enters said crank chamber.

5. A variable capacity piston-operated refrigerant compressor according to claim 4, wherein said cavity portion of said oil separating means comprises a generally cylindrical cavity bored in said cylinder block.

6. A variable capacity piston-operated refrigerant compressor according to claim 4, wherein said wall of said cavity portion comprises a cylindrical wall defining said cavity portion as a cylindrical cavity portion having a diameter larger than a diameter of said gas supply passage, said cylindrical cavity portion being arranged to be eccentric and downwardly deviated from said gas supply passage.

7. A variable capacity piston-operated refrigerant compressor according to claim 4, wherein a screen member is arranged in said cavity portion of said oil separating means to promote separation of the lubricating oil from the refrigerant gas.

8. A variable capacity piston-operated refrigerant compressor according to claim 1, further comprising a valve means for opening and closing a gas suction passage in response to a change in a refrigerating load, and wherein said cam plate element mounted around said drive shaft comprises a single swash plate turntable to change an angle of inclination thereof under the guidance of a hinge mechanism arranged in said crank chamber, said swash plate being operatively engaged with said valve means to control the opening and closing motion of said valve means in response to a change in the angle of inclination of said swash plate.

9. A variable capacity piston-operated refrigerant compressor according to claim 1, wherein the capacity control valve comprises:

a valve element moveable between an opening position for providing a fluid communication between said discharge chamber and said crank chamber and a closing position restricting said fluid communication;

a bellows element operatively connected to said valve element and arranged to move said valve element in response to a change in a pressure prevailing in said suction chamber.

10. A variable capacity piston-operated refrigerant compressor according to claim 9, wherein said capacity control valve further comprises:

a movable iron core member moved between an extended position and a retracted position in response to deenergizing and energizing of said solenoid, said movable iron core being operatively engaged with said valve element via said bellows element and urging said valve element to said opening position thereof when said movable iron core is at said extended position.

* * * * *